US005499484A

United States Patent [19]

Herrin

[11] Patent Number: 5,499,484

[45] Date of Patent: Mar. 19, 1996

[54] DISPLAY CONTAINER

[75] Inventor: Melvin B. Herrin, Rydal, Pa.

[73] Assignee: Klearfold, Inc., Warrington, Pa.

[21] Appl. No.: 204,767

[22] Filed: Mar. 1, 1994

Related U.S. Application Data

[63] Continuation-in-part of Ser. No. 195,751, Feb. 10, 1994, Pat. No. 5,458,233.

[51] Int. Cl.[6] ..... B65B 43/26; B65B 3/02

[52] U.S. Cl. ..... 53/458; 53/467; 53/468

[58] Field of Search ..... 53/458, 467, 477, 53/484, DIG. 2

[56] References Cited

U.S. PATENT DOCUMENTS

| | | | |
|---|---|---|---|
| 663,133 | 12/1900 | Shipley, Jr. | 53/484 X |
| 1,854,319 | 4/1932 | Van Wormer | 53/484 X |
| 2,659,526 | 11/1953 | Buttery . | |
| 3,430,845 | 3/1969 | Susuki et al. . | |
| 3,455,496 | 7/1969 | Franz | 53/458 X |
| 3,468,731 | 9/1969 | Obeda | 53/DIG. 2 X |
| 3,625,411 | 12/1971 | Cote . | |
| 3,659,704 | 5/1972 | Collura et al. . | |
| 3,879,247 | 4/1975 | Dickey | 53/477 X |
| 3,956,046 | 5/1976 | Tsuchiya et al. | 53/DIG. 2 X |
| 3,997,091 | 12/1976 | Burnette . | |
| 4,341,341 | 7/1982 | Roccaforte . | |
| 4,347,930 | 9/1982 | Herrin . | |
| 4,504,350 | 3/1985 | Joo | 53/DIG. 2 X |
| 4,548,352 | 10/1985 | Capo et al. . | |
| 4,648,548 | 3/1987 | Shin . | |
| 4,742,914 | 5/1988 | Klein . | |
| 4,858,756 | 8/1989 | Herrin et al. . | |
| 5,069,334 | 12/1991 | Herrin et al. . | |
| 5,117,972 | 6/1992 | Herrin et al. . | |
| 5,337,538 | 8/1994 | Ljungstrom | 53/458 X |

*Primary Examiner*—Horace M. Culver

*Attorney, Agent, or Firm*—Lerner, David, Littenberg, Krumholz & Mentlik

[57] ABSTRACT

A display container comprises permanent side walls, a first end with at least two side wall flanges depending from the side walls and a second end sealable to form a closed bottom wall. At least a portion of one of the side wall flanges is permanently bonded to another side wall flange to form a closed, bonded top wall to maintain the display container in a permanently sealed condition so that product placed inside the container is inaccessible from either the top or bottom wall. A method of packaging incorporating the display container is also provided.

25 Claims, 6 Drawing Sheets

DISPLAY CONTAINER

CROSS-REFERENCE TO RELATED APPLICATION

This application is a continuation-in-part of application Ser. No. 08/195,751 filed on Feb. 10, 1994, and now U.S. Pat. No. 5,458,233, the disclosure of which is hereby incorporated by reference herein.

FIELD OF THE INVENTION

The present invention relates to display containers and a method of packaging incorporating such a display container, wherein the display container comprises side walls, a first end sealable to form a closed top wall and a second end sealable to form a closed bottom wall. At least one of the first and second ends is permanently bonded to maintain the display container in a permanently sealed condition so that product inside the display container is inaccessible.

BACKGROUND OF THE INVENTION

Today in nearly every store, transparent display containers are used for packaging and displaying almost any item imaginable, such as audio and video cassettes, hair dryers, office supplies, and even articles of clothing such as socks, scarves and underwear. Such transparent plastic display containers are widely used in packaging because of their many advantages over other available types of packaging containers, such as opaque, cardboard boxes. One obvious advantage is that transparent plastic display containers allow the consumer to view the contents without having to open the container. Other advantages of such transparent display containers include the fact that they are lightweight, sturdy, recyclable, easily set up and assembled, and provide a high quality look or appearance.

With transparent plastic display containers, it is also important to the packager that they be both "pilfer proof" and "selection proof." By the phrase "pilfer proof," it is meant that the container should be difficult to open in a store without using a pair of scissors or the like in order to discourage theft of items inside the container. By the phrase "selection proof," it is meant that the container should prevent the unauthorized customer selection or "swapping" of one or more items in one container with items from another container. For example, if a number of different colored scarves are offered in a typical "variety pack," the container should prevent consumers from breaking up the intended set of scarves in the variety pack by taking out certain scarves and replacing them with scarves of different colors from other packs.

Presently, some transparent plastic display containers are commercially available which can be formed to be both "pilfer" and "selection proof" as described above. Once such type of plastic display container is fabricated by the process of thermoforming. Thermoformed containers, however, have the disadvantage of being quite costly to manufacture and require molds of different shapes and sizes to form a different sized container for each type of product to be packaged. Another disadvantage of thermoformed containers is that they are molded to form containers that are already in their "set up" condition and, therefore, are not capable of being stored and shipped in a flat condition as with typical foldable cardboard boxes.

Other transparent plastic display containers, such as the container disclosed in commonly-owned U.S. Pat. No. 5,069,334, are advantageous over thermoformed containers because they can be stored and shipped in a flat condition and easily set up by standard packaging machinery or by hand. However, once they are set up, such display containers can be readily opened from either end unless the ends are truly permanently sealed by the packager. Although it is known to glue top and bottom wall flaps to seal the container, this method of sealing typically does not provide a sufficiently permanent seal so as to deter or prevent the unauthorized opening of or tampering with the container.

With regard to displaying one or more of such transparent display containers in stores to prospective purchasers, such transparent display containers are typically suspended from display racks. To facilitate such suspension, the containers are usually provided with an upstanding side wall extension or hanging flange having an opening therein such as a "J-hook" recess to allow the container to hang from, for example, a metal bracket in a peg board. Although many transparent display containers provide a hanging J-hook or the like in an upper extension of a side wall, this construction can be problematic because of the sometimes flimsy extension flange incorporating the J-hook which has the same thickness as the side wall. Thus, it is desirable to provide a transparent display container having a hanging flange with a J-hook or the like with sufficient rigidity so that the display containers will not unintentionally slip or fall off the rack.

Accordingly, in light of the aforementioned shortcomings of currently available display containers, there has been a long-felt need to provide an improved transparent plastic display container that is capable of being stored and shipped in a flat condition and set up by standard packaging machinery or by hand, less expensive to manufacture than thermoformed display containers, and both pilfer and selection proof by providing permanently sealed top and bottom walls. In addition, there is also a need to provide such a display container with a hanging flange having sufficient rigidity for hanging the container from a display rack or the like.

Moreover, there is also a need to reduce the number of steps needed to be taken by the packager utilizing such a container, and this achieved in one aspect of the present invention by providing a transparent plastic display container having an "automatic bottom" that is pre-sealed along at least a portion of one end prior to set up such that it automatically forms a sealed bottom wall when the container is moved to its set up condition. Moreover, there is also a need to provide a readily fillable display container adapted to receive product when the container is moved to its set up position. Even further, there is a need to provide a display container where the packager does not have to be concerned with accurately sealing at least one wall after the container is moved to a setup position and filled with product.

SUMMARY OF THE INVENTION

The present invention meets these above needs. According to the present invention, there is provided a method of packaging comprising the steps of providing a display container having permanent side walls, a sealable open end having a pair of side wall flanges depending from opposing side walls, each of the side wall flanges having a seal region. The display container further comprises an end sealable to form a closed bottom wall, and more preferably, the end being permanently presealed along at least a portion thereof such that when the display container is moved to its setup position the presealed end forms a closed bottom wall. The method further includes setting up the display container to its setup position to form a walled enclosure such that the presealed end forms the closed bottom wall and the step of filling the display container with a desired product. The method also further includes permanently bonding at least a portion of one of the seal regions to the other seal region to form both a closed top wall and a bonded portion extending therefrom to maintain the display container in a permanently sealed condition so that the product inside is inaccessible from either the bottom or top wall.

In one embodiment of the present invention, each of the side wall flanges comprises a first region adjacent one of the side walls and a second region adjacent the first region, and the step of permanently bonding includes the step of permanently bonding at least a portion of one of the second regions to the other second region such that the second regions form the bonded portion and the first regions form the closed top wall. Preferably, the first region of each of the side wall flanges depends from the side wall by a fold line and the second region depends from the first region by a fold line and is coextensive therewith.

In another embodiment of the invention, one of the side wall flanges comprises a first region adjacent the side wall and a second region adjacent a first region, and the step of permanently bonding includes the step of permanently bonding at least a portion of the second region to the seal region of the opposing side wall flange such that the second region and the seal region form the bonded portion and the first region forms the closed top wall. Preferably, the first region depends from the side wall by a fold line, the second region depends from the first region by a fold line and is coextensive therewith, and the seal region of the opposing side wall flange depends from the side wall by a fold line.

In the preferred embodiment, the bonded portion is formed with a J-hook recess therein to facilitate hanging the display container from a rack, and more preferably, complimentary J-hook recesses are formed in opposing seal regions.

The step of permanently bonding may comprise radio-frequency (RF) heat sealing, ultrasonic frequency sealing, or vibration welding. The display container is preferably formed from totally transparent material and is capable of being stored and shipped in a flat condition and set up by standard packaging machinery or by hand.

The method according to the present invention can further include the step of placing at least one insert member inside the display container for displaying desired information about the product, and preferably, the insert member is formed from opaque material and is coextensive with at least a portion of one of the side walls.

In accordance with another aspect of the present invention, a display container is provided comprising permanent side walls, an end sealable to form a closed bottom wall, and more preferably, the end being permanently presealed along at least a portion thereof to form a closed bottom wall when the display container is moved to its setup position, and an open end having a pair of side wall flanges depending from opposing side walls. Each of the side wall flanges has a seal region. At least a portion of one of the seal regions is permanently bonded to the other seal region to form both a closed top wall and a bonded portion extending therefrom to maintain the display container in a permanently sealed condition so that product placed inside the container is inaccessible from either the top or bottom wall.

In one embodiment of the display container, each of the side wall flanges comprises a first region adjacent one of the side walls and a second region adjacent the first region. At least a portion of one of the second regions is permanently bonded to the other second region such that the second regions form the bonded portion and the first regions form the closed top wall. Preferably, the first region of each of the side wall flanges depends from the side wall by a fold line and the second region depends from the first region by a fold line and is coextensive therewith.

In accordance with another aspect of the display container, one of the side wall flanges comprises a first region adjacent the side wall and a second region adjacent the first region. At least a portion of the second region is permanently bonded to the seal region of the opposing side wall flange such that the second region and seal region form the bonded portion and the first region forms the closed top wall. Preferably, the first region depends from the side wall by a fold line, the second region depends from the first region by a fold line and is coextensive therewith, and the seal region of the opposing side wall flange depends from the side wall by a fold line.

The bonded portion of the display container is preferably formed with a J-hook recess therein to facilitate hanging the display container from a rack, and more preferably, complimentary J-hook recesses are formed in opposing seal regions. More preferably, the bonded portion is permanently bonded by radio-frequency (RF) heat sealing, ultrasonic frequency sealing, or vibration welding.

The display container is also preferably formed from totally transparent material and is capable of being stored and shipped in a flat condition and set up by standard packaging machinery or by hand.

At least one insert member may be provided for insertion into the display container to display desired information about the product, the insert member preferably being formed from opaque material and being coextensive with at least a portion of one of the side walls.

The present invention further provides a method of packaging comprising the steps of providing a display container comprising permanent side walls, a first end having at least two side wall flanges depending from the side walls, and a second end sealable to form a closed bottom wall. The method includes setting up the display container to its set up position to form a wall enclosure, filling the display container with a desired product, sealing the second end to form the closed bottom wall, and permanently bonding at least a portion of one of the side wall flanges to at least another side wall flange to form a closed, bonded top wall to maintain the display container in a permanently sealed condition so that the product inside the display container is inaccessible from either the top or bottom wall.

In accordance with another method of the present invention, a display container is provided having permanent side walls, a first end having at least one side wall flange depending from one of the side walls, and a second end sealable to form a closed bottom wall. The method includes setting up the display container to its set up position to form a walled enclosure, filling the display container with the desired product, sealing the second end to form the closed bottom wall, and permanently bonding at least a portion of the side wall flange to at least one of the side walls to form a closed, bonded top wall to maintain the display container in a permanently-sealed condition so the product inside the container is inaccessible from either the top or bottom wall. More preferably, a single side wall flange is provided having a front tuck flap and a pair of side tuck flaps extending therefrom, and the step of permanently bonding includes permanently bonding at least a portion of the front and side tuck flaps to corresponding side walls of the display container to form the closed, bonded top wall.

In either method, the second end may comprise at least two side wall flanges depending from the side walls, and the step of sealing the second end may comprise the step of permanently bonding at least a portion of one of the side wall flanges of the second end to another side wall flange to form a closed, bonded bottom wall.

The step of permanently bonding may comprise radio-frequency (RF) heat sealing, ultrasonic frequency sealing or vibration welding. In addition, the display container may be provided in a flat condition and the step of setting up can be performed by standard packaging machinery or by hand.

Rather than providing a permanently bonded bottom wall, one preferred method provides that the second end is permanently pre-sealed along at least a portion thereof and so constructed such that when the display container is moved to its set up position, the pre-sealed end will form the closed bottom wall.

In accordance with another aspect of the present invention, a display container is provided having permanent side walls, a first end having at least two side wall flanges depending from the side walls, and a second end sealable to form a closed bottom wall. At least a portion of one of the side wall flanges is permanently bonded to another side wall flange to form a closed, bonded top wall to maintain the display container in a permanently sealed condition so that product placed inside the display container will be inaccessible from either the top or bottom wall.

In accordance with another preferred embodiment, a display container is provided having permanent side walls, a first end having at least one side wall flange depending from one of the side walls, and a second end sealable to form a closed bottom wall. In this embodiment, at least a portion of the side wall flange is permanently bonded to one of the side walls of the container to form a closed, bonded top wall to maintain the display container in a permanently sealed condition. More preferably, the side wall flange comprises a front tuck flap and a pair of side tuck flaps extending therefrom, and at least a portion of the front and side tuck flaps are permanently bonded to corresponding side walls of the display container to form the closed, bonded top wall.

The second end of the display container may further comprise at least two side wall flanges depending from the side walls, and at least a portion of one of the side wall flanges can be permanently bonded to another side wall flange to form a closed, bonded bottom wall.

Preferably, the display container may comprise a hanging tab portion extending from the bonded top wall provided with a recess therein to facilitate hanging the display container from a rack. Preferably, the recess is J-shaped. The hanging tab portion may also be formed from first and second complimentary portions which may be permanently bonded to one another. The hanging tab portion can also be integrally formed with the display container.

Preferably, at least a portion of one of the side wall flanges of the display container is permanently bonded to another side wall flange by radio-frequency (RF) heat sealing, ultrasonic frequency sealing, or vibration welding. Preferably, the display container is formed from totally transparent material and at least one insert member is provided for insertion into the display container to display the desired information about the enclosed product(s). The display container may also be provided such that it is stored and shipped in a flat condition and set up by standard packaging machinery or by hand.

An automatic bottom may be provided instead of the permanently bonded bottom by providing the second end with a permanently pre-sealed portion constructed such that when the display container is moved to its set up position, the pre-sealed end will form a closed bottom wall.

These and other objects, features and advantages of the present invention will be more readily apparent from the detailed description of the preferred embodiments set forth below, taken in conjunction with the accompanying drawings.

DETAILED DESCRIPTION OF THE PREFERRED EMBODIMENTS

Figure 1:
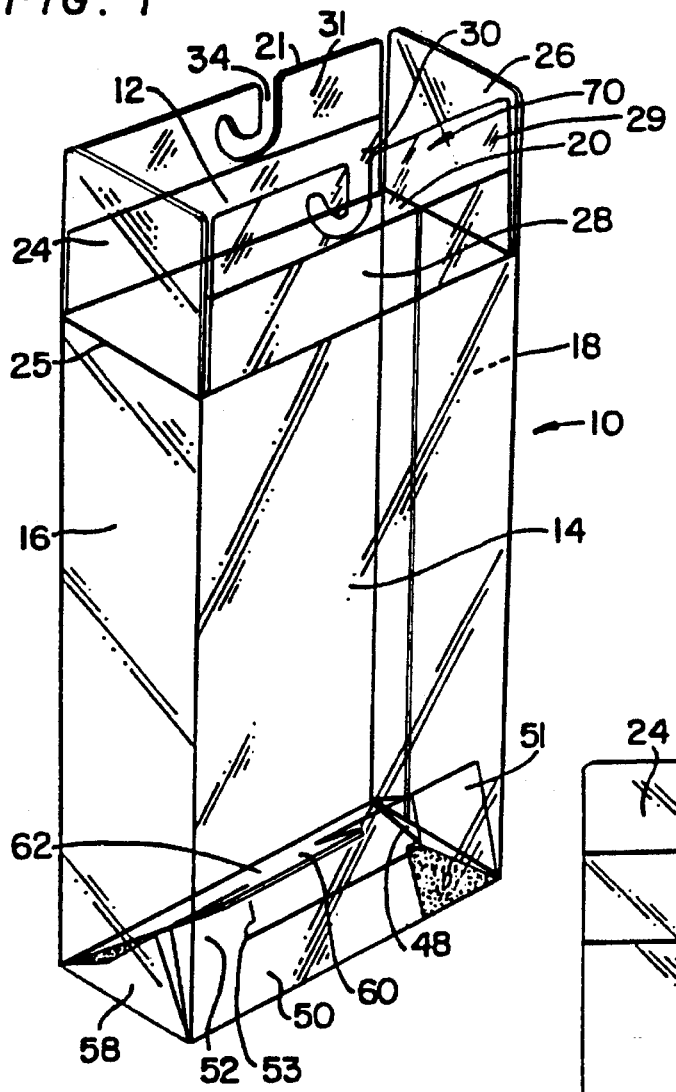
FIG. 1 is a perspective view of a display container in a partially set up position in accordance with the present invention.

Referring to the figures in which like numerals refer to like portions thereof, there is shown in FIG. 1 a display container in accordance with one embodiment of the present invention generally designated as 10. Display container 10 includes a rear wall 12, a front wall 14, and side walls 16 and 18. Rear wall 12 is provided with an integral panel 20 connected thereto by a fold line. Alternatively, integral panel 20 could be connected to side wall 18 by a fold line as well instead of being connected to side wall 16. Front wall 14 is connected to side walls 18 and 16 by fold lines, and likewise side wall 16 and integral panel 20 are connected to rear wall 12 by fold lines.

Side wall 16 is provided with an upper side wall flange 24 which is connected thereto by a fold line, and likewise, upper side wall flange 26 is connected to side wall 18 by a fold line. Front wall 14 is provided with a first region 28 which is connected to front wall 14 by a fold line, and a second region 29 adjacent to first region 29 and preferably coextensive therewith. Likewise, rear wall 12 is provided with a side wall flange having a first region 30 which is in turn connected to rear wall 12 by a fold line, and a second region 31 which is adjacent to first region 30 and preferably coextensive therewith. Second regions 29 and 31 are preferably co-extensive with and connected to first regions 28 and 30 respectively by fold lines. Second regions 29 and 31 are preferably formed with corresponding J-shaped channels 34 and 35 constructed to form an integral "J-hook" for facilitating the suspension of display container 10 from a hanging rack or the like when second regions 29 and 31 are permanently bonded together as will be discussed below. It is appreciated that rather than providing J-shaped channels, other arrangements may be employed to allow display container 10 to hang from a display rack such as by providing small apertures in second regions 29 and 31. In addition, if display container 10 is to be displayed on a shelf or the like, second regions 29 and 31 need not be provided with a J-shaped channel and could be solid throughout.

Side wall 18 is further provided with a lower side wall flange 48 connected thereto by a fold line and sidewall 16 is provided with a lower side wall flange 58, also connected thereto by a fold line. Lower side wall flanges 48 and 58 are preferably formed with diagonal fold lines defining lower side wall flange seal areas 49 and 59 respectively, which will be described in further detail below. Front wall 14 is connected to a lower front wall flange 50 which is connected thereto by a fold line and rear wall 12 is connected to a lower rear wall flange 60, also connected thereto by a fold line.

Figure 5:
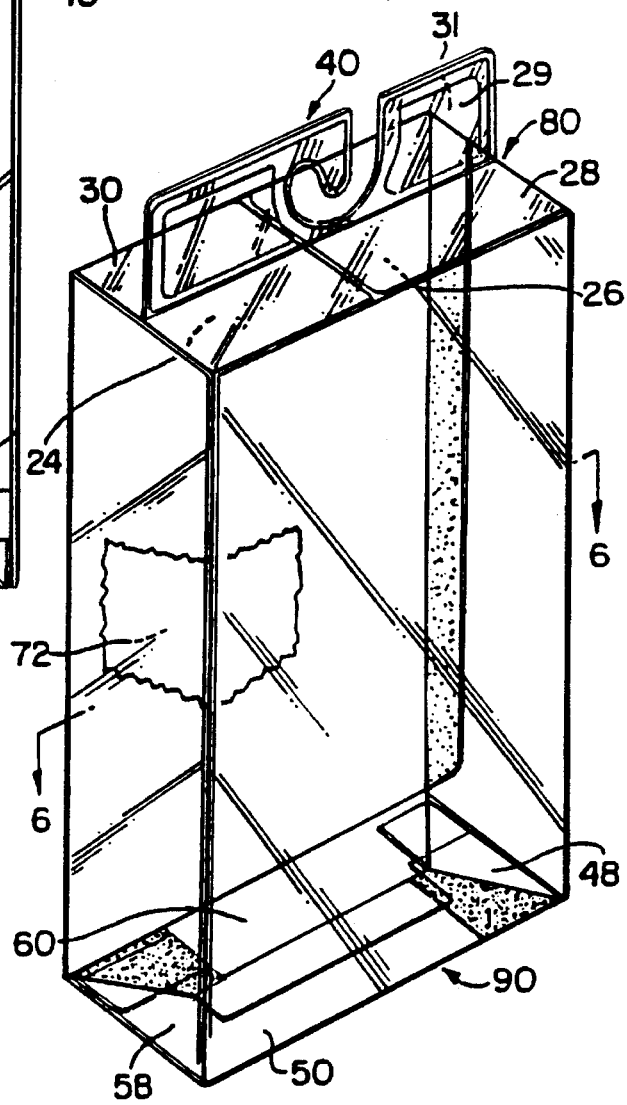
FIG. 5 is a perspective view of the container in its fully set up and sealed condition.
Figure 6:
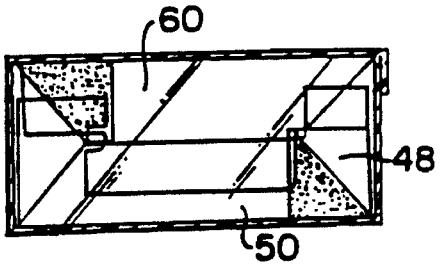
FIG. 6 is a sectional view taken along the line 6—6 in FIG. 5.

As can be seen in FIGS. 1 and 5, upper side wall flanges 24 and 26, first regions 28 and 30, and second regions 29 and 31 all are constructed to extend inwardly toward one another to form a top wall, generally designated as 80, when display container 10 is set up, filled and ready to be sealed closed. Once display container 10 is set up and filled with product, second regions 29 and 31 can be permanently bonded to one another such that first regions 28 and 30 thereby form closed top wall 80 to provide a tamper-proof and selection-proof display container and second regions 29 and 31 form a bonded portion or hanging flange 40 extending from top wall 80. By the term "permanently bonded", it is meant that second regions 29 and 31 are permanently affixed or sealed together by radio frequency (RF) heat sealing, ultrasonic frequency sealing, vibration welding, or other type of similar permanent bonding, as opposed to mere gluing. Preferably, second regions 29 and 31 are permanently bonded together along their entire surfaces so as to provide a strong seal, although it is possible to permanently bond only select portions of second regions 29 and 31 together so long as a sufficient seal is maintained. With this type of permanent bonding, not only is a closed top wall 80 formed, but a reinforced and desirably rigid hanging flange 40 comprising bonded second regions 29 and 31 is simultaneously formed. The additional reinforcement of providing a double-layer hanging flange 40 allows a relatively large J-hook to be formed therein without affecting the rigidity of hanging flange 40. Moreover, the permanent bonding of second regions 29 and 31 when container 10 is in its set up condition acts to maintain the container in a rigid closed condition such that any product inserted therein in now inaccessible from either top wall 80 or bottom wall 90 (see FIG. 5).

Figure 8:
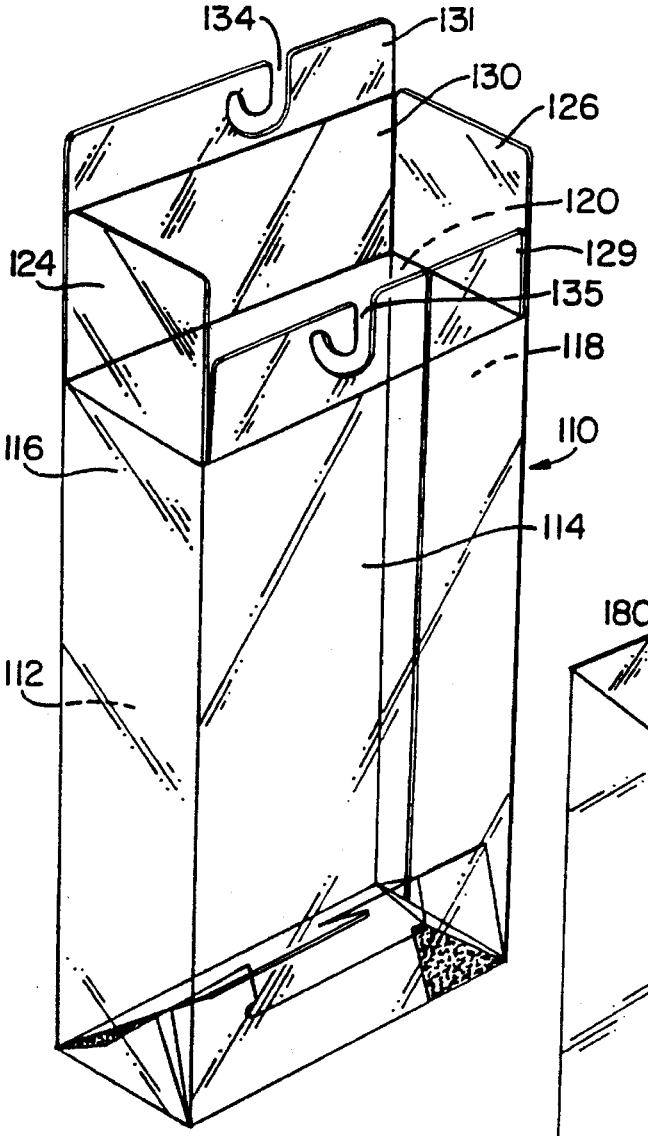
FIG. 8 is a perspective view of a container in accordance with another embodiment of the present invention.
Figure 9:
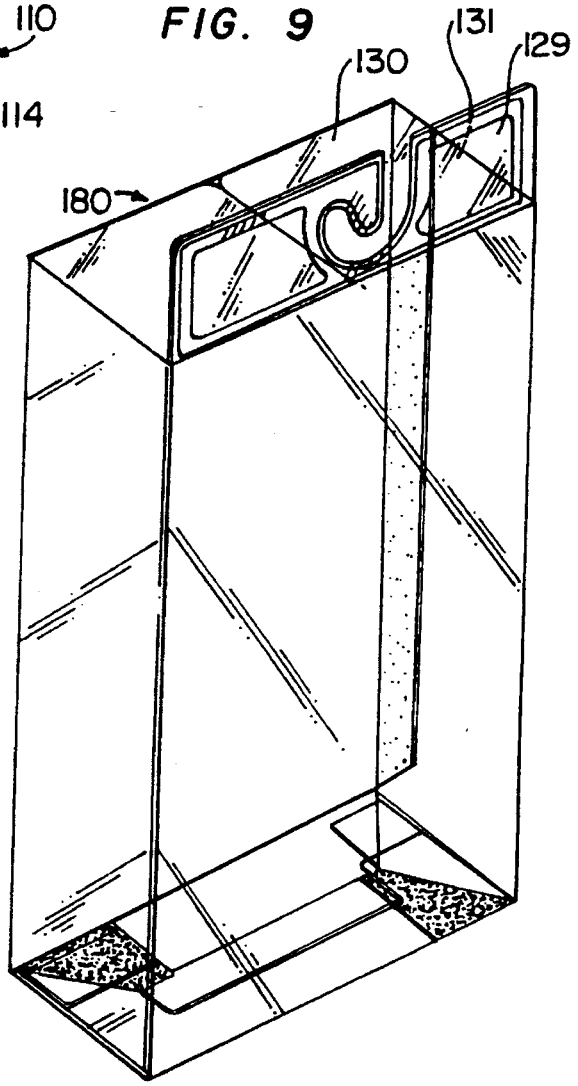
FIG. 9 is a perspective view of the container shown in FIG. 8 in its fully set up and sealed condition.

Referring now to FIGS. 8 and 9, another embodiment of the present invention is shown. Accordingly, the display container, generally designated as 110, includes a rear wall 112, a front wall 114, and sidewalls 116 and 118. Rear wall 112 is provided with an integral panel 120 connected thereto by a fold line. Front wall 114 is connected to side walls 116 and 118 by fold lines, and likewise, side wall 116 and integral panel 120 are connected to rear wall 112 by fold lines.

Side wall 116 is provided with upper side wall flange 124 which is connected thereto by a fold line, and likewise, upper side wall flange 126 is connected to side wall 118 by a fold line. Front wall 114 is further provided with a seal region 129 which is connected to front wall 114 by a fold line. Rear wall 112 is provided with a side wall flange having a first region 130 which is in turn connected to rear wall 112 by a fold line, and a second region 131 which is adjacent to first region 130 and preferably coextensive therewith. Seal region 129 and second region 131 are preferably formed with corresponding J-shaped channels 134 and 135 constructed to form an integral J-hook as described above. Once display container 110 is set up and filled with product, seal region 129 and second region 131 can be permanently bonded to one another such that first region 130 thereby forms a closed top wall generally designated as 180, and seal region 129 and second region 131 form a bonded portion or hanging flange 140 extending from top wall 180. Seal region 129 and second region 131 are permanently bonded to one another by radio-frequency (RF) heat sealing, ultrasonic frequency sealing, vibration welding, or other type of similar permanent bonding, and are preferably bonded to one another along their entire surfaces so as to provide a strong and permanent seal.

Figure 2:
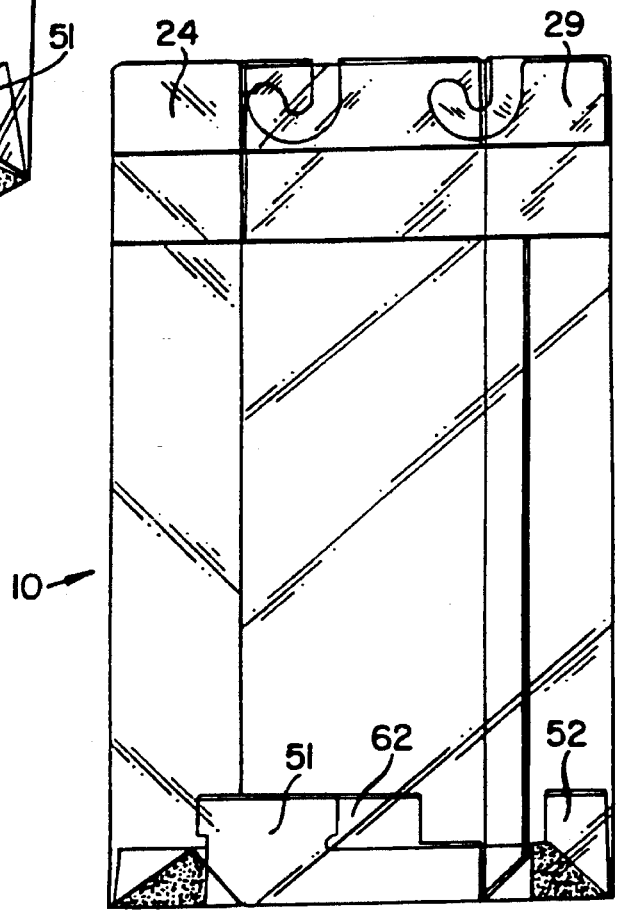
FIG. 2 is a front view of the container in a flat storage or shipping condition prior to set up.
Figure 3:
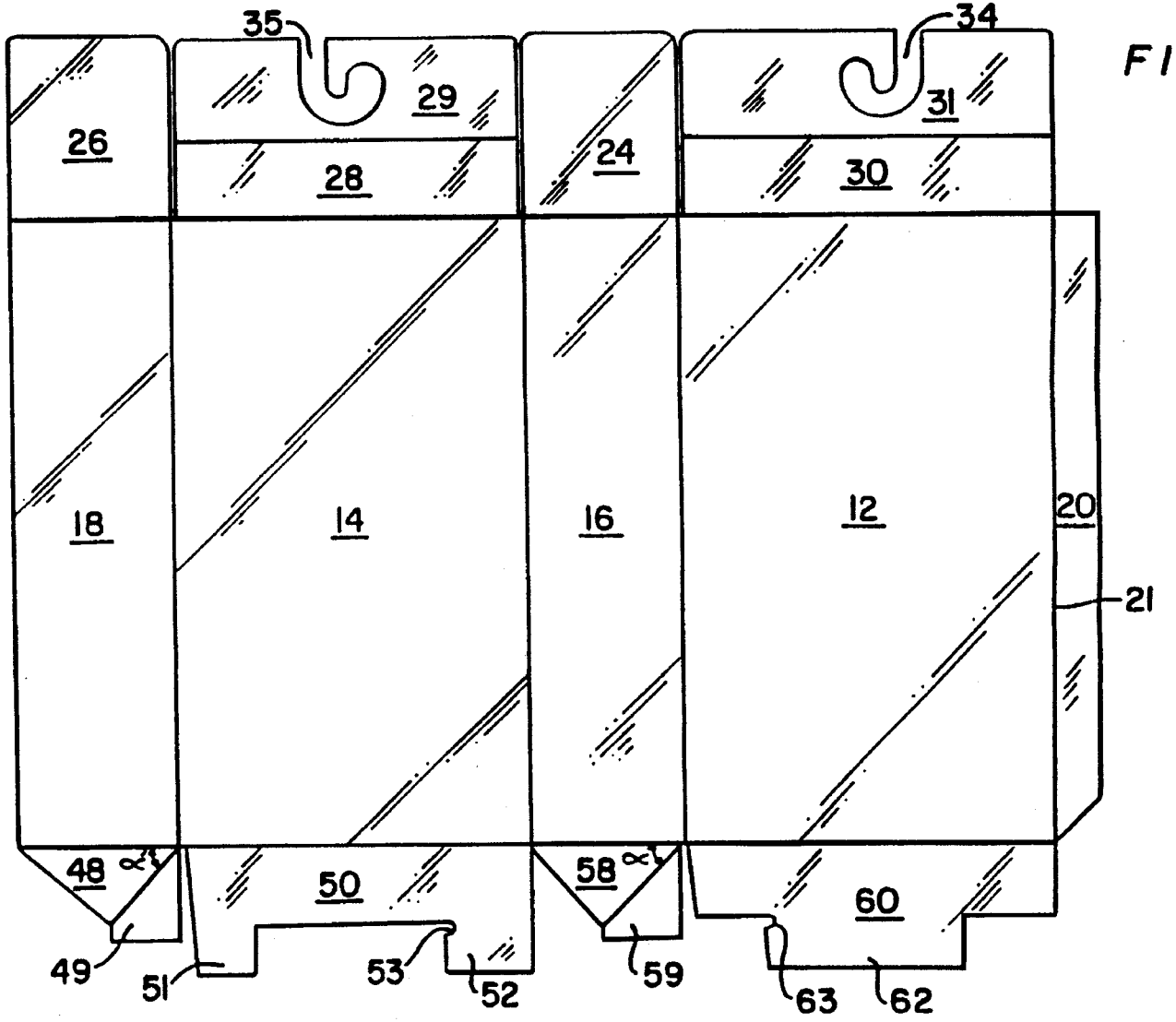
FIG. 3 is a plan view of a blank used in the manufacturer of the container.
Figure 4:
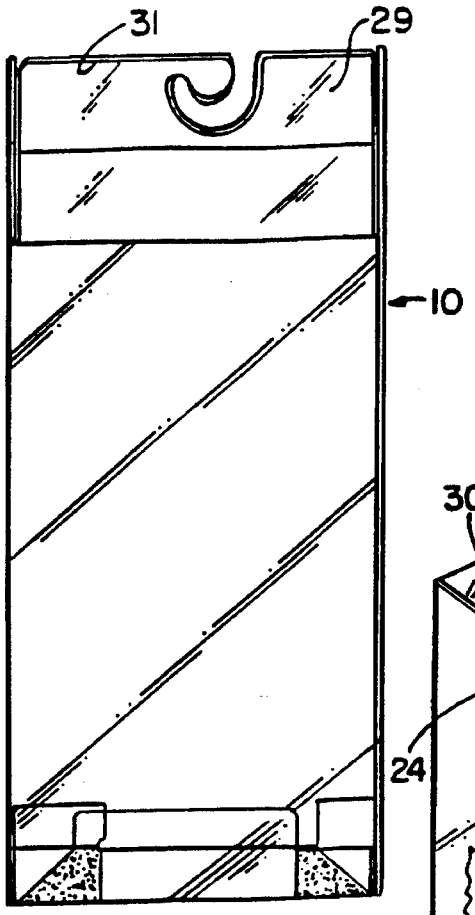
FIG. 4 is a front view of the container shown in FIG. 1.

Referring to FIG. 3, it can be seen that lower side wall flange seal area 59 is provided with a fold line at approximately a 45 degree angle $\alpha$ such that seal area 59 is adapted to overlap lower rear wall flange 60 for attachment thereto when display container 10 is fabricated into its storage or shipping condition. Likewise, lower side wall flange seal area 49 is provided with a fold line at approximately a 45 degree angle 60' such that seal area 49 is adapted to overlap lower front wall flange 50 for attachment thereto. Preferably, seal areas 49 and 59 are permanently attached to lower rear and front wall flanges 50 and 60 respectively by an adhesive or thermoplastic coating prior to delivering the container to the customer. In this manner, when seal areas 49 and 59 are permanently "pre-sealed" to lower front wall flange 50 and lower rear wall flange 60 respectively, and integral panel 20 is bonded to side wall 18, display container 10 will be in its storage or shipping state and will have a configuration as shown in FIG. 2, which depicts display container 10 in its flat shipping or storage condition.

This "automatic bottom" or "pre-sealed" end feature which is well known in the field of folding cartons, is preferably used in the present invention although other sealable bottoms may also be used such as by providing a bottom having a tuck flap that can be glued inside the container once the container is set up. In addition, seal areas 49 and 59 need not be pre-sealed and can be glued or otherwise sealed by the customer prior to set up of the container.

With the preferred automatic bottom, however, lower front and rear wall flanges 50 and 60 are constructed in such a manner so as to interlock and form a closed bottom wall, generally designated as 90 (FIG. 5), when display container 10 is moved from its flat configuration (as shown in FIG. 2) to its fully set up condition (as shown in FIG. 5). Accordingly, in the preferred embodiment, lower rear wall flange 60 includes an integral tab 62 and a notch 63, as seen best in FIG. 3. Lower front wall flange 50 is provided with integral tabs 51 and 52 and also has a corresponding notch 53 for locking engagement with notch 63 when display container 10 is moved to its set up position to form bottom wall 90.

The manner in which bottom wall 90 is automatically formed when display container 10 is moved from a flat configuration to its set up position will now be described in further detail with reference to FIGS. 1, 2, 5, 7. Accordingly, FIG. 2 shows display container 10 in a pre-sealed, flat condition as described above, suitable for storage and shipping to end user or "filler," who in turn will set up the container, fill it with product, and then permanently bond second regions 29 and 31 at the remaining open end. When display container 10 is in a completely flat condition, it is ideal for shipping and storage because it takes up a relatively small volume as compared to thermoformed containers or the container in its fully set up condition.

Referring now to FIG. 1, display container 10 is shown in a partially set up condition as opposing pairs of walls (i.e., front wall 14 and rear wall 12, and side walls 16 and 18) are moved in opposing parallel directions to begin to form a walled enclosure. In this partially set up condition, integral tab 51 temporarily rests in an approximately perpendicular fashion on a portion of integral tab 62 of lower rear wall flange 60.

Figure 7:
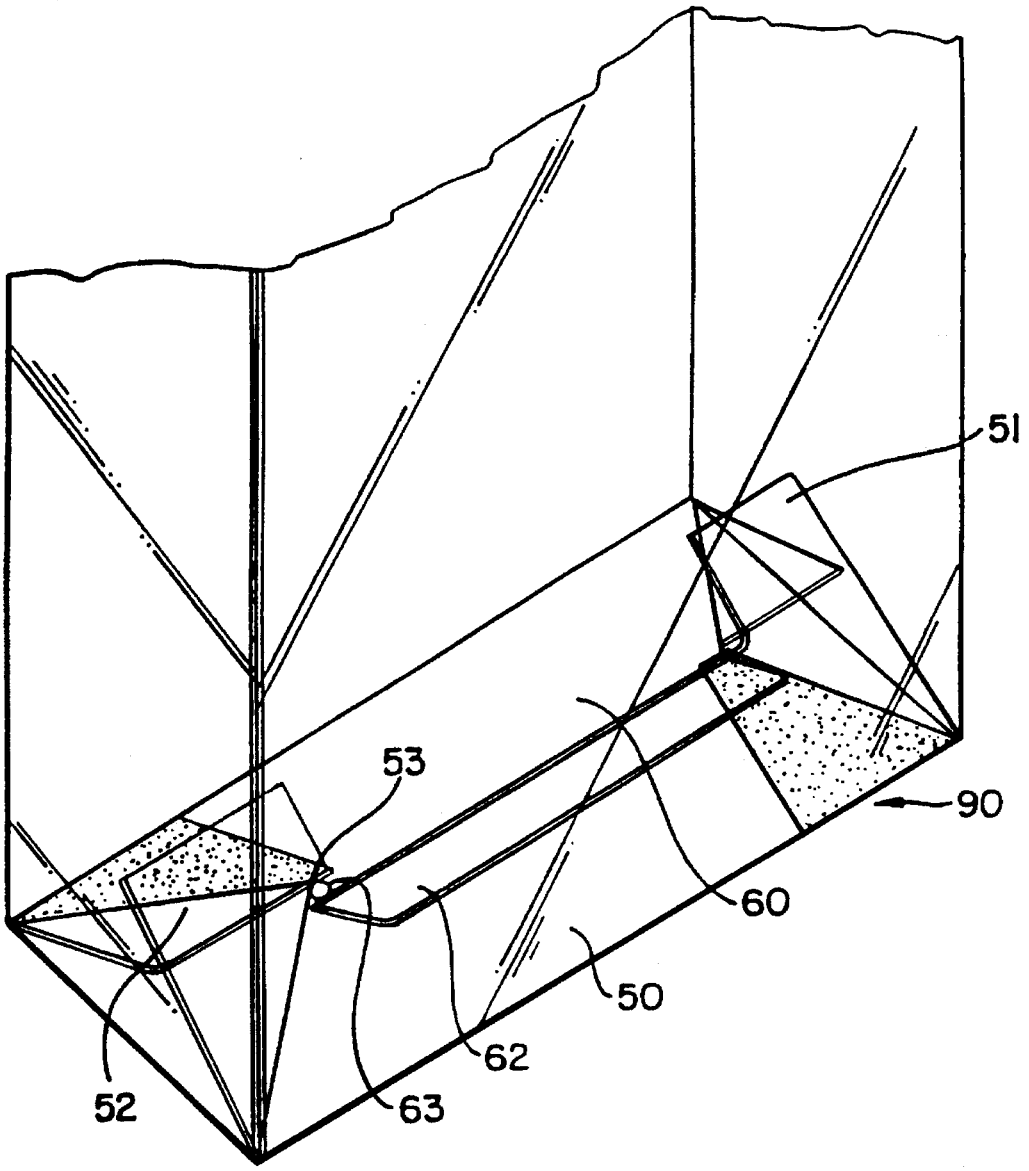
FIG. 7 is an enlarged perspective view of a section of the container almost in its set up condition.

Referring to FIG. 7, which illustrates the bottom half of display container 10, display container 10 is shown in an almost fully set up condition as integral tab 62 of lower rear wall flange 60 now interlocks between integral tabs 51 and 52 of lower front wall flange 50 and integral tab 62 overlaps lower front wall flange 50. In this position, notches 53 and 63 co-act to help frictionally engage and retain lower front and rear wall flanges 50 and 60.

FIG. 5 shows display container 10 in its fully set up and sealed condition (absent product) whereby lower side wall flanges 48 and 58, lower front and rear wall flanges 50 and 60 together form closed bottom wall 90. Prior to forming top wall 80, any type of desired product may be introduced into display container 10 via open top 70 as shown in FIG. 1. In addition, a display insert 72 can be inserted into display container 10 for displaying information about the product. Preferably, display insert 72 is formed from opaque material such as cardboard.

The preferred "pre-sealed" end that forms bottom wall 90 when display container 10 is moved to its set up condition, although a common feature in folding cartons, is a highly advantageous when used in combination with the instant invention because the customer or filler of display container 10 does not have to be concerned with permanently sealing bottom wall 90 once display container 10 is moved to its set up position and filled with product. In addition, when display container 10 is moved to its set up position, the filler or packager is provided with a stationary ready-fillable container since display container 10 will remain in its fully set up position when lower front and rear wall flanges 50 and 60 interlock to form bottom wall 90 as described above. Moreover, this pre-sealed end in combination with the permanent bonding of second regions 29 and 31 provides an overall tamper and selection proof display container from both ends.

It will be appreciated that display container 10 has numerous advantages over other display containers, such as thermoformed display containers and completely transparent display containers of the prior art. Thus, display container 10 can be manufactured without employing costly molds used in thermoforming, without specialized production equipment, and without materially varying present production techniques. At the same time, display container 10 can be stored and shipped in a flat condition. Display container 10 can be easily set up by standard packaging machinery or by hand such that when it is moved to its set up condition, in the preferred embodiment, it will automatically form a walled enclosure capable of receiving product with the "pre-sealed" end forming a closed bottom wall. The container is then ready to receive product, i.e., it can be filled, and upon the permanent bonding of second regions 29 and 31 to form top wall 80, the product inside the display container thereby becomes inaccessible from either top wall 80 or bottom wall 90, and thus provides both a pilfer-proof and selection-proof display container as described above.

Although display container 10 has been described herein as having top and bottom walls, it should be understood that either end of display container 10 may function as the top or bottom. In addition, the sealable end, which has been described as forming bottom wall 90 when display container 10 is moved to its set up position, can be provided along any wall such that upon set up, a closed wall or "bottom wall" is formed as described. For example, the "bottom wall" may be a side wall where filling takes place from one side with such one side then being a "top wall" within the context of the present invention.

A method of packaging incorporating the display container of FIGS. 1–7 of the present invention will now be described below.

In the first step of packaging, display container 10 as described above is preferably provided with a pre-sealed end formed by permanently attaching seal areas 49 and 59 to lower front and rear wall flanges 50 and 60 respectively. Next, when display container 10 is moved from its flat condition (shown in FIG. 2) to its set up position, closed bottom wall 90 is automatically formed as integral tab 62 interlocks between integral tabs 51 and 52 and overlaps lower front wall flange 50. Again, as described above, although the automatic bottom is preferably used with the present method, a bottom having a sealable or gluable tuck flap may be used or the customer may glue the seal areas himself prior to set up.

At this point, top 70 of the display container 10 is not yet closed, and in the next step, display container 10 can be filled with any desired product via top 70. In addition, prior or subsequent to filling display container 10 with product, but before it is permanently bonded closed, display insert 72 can be inserted therein for displaying information about the contents of display container 10. Preferably, display insert 72 is formed from an opaque material such as cardboard and can be providing with desired lettering and graphics to provide a finished, professional look. After display container 10 is filled with product, and display insert 72 if desired, second regions 29 and 31 are then permanently bonded, preferably by RF heat sealing as described above, to form both hanging flange 40 and closed top wall 80 such that the product inside display container 10 is now inaccessible from either bottom wall 90 or top wall 80, which are now both sealed.

It should be appreciated that while the foregoing method has been described with reference to the embodiment shown in FIGS. 1–7, the method can be likewise adapted to the embodiment shown in FIGS. 8 and 9. For example, in the step of permanently bonding, seal region 129 and second region 130 are permanently bonded to one another to form closed top wall 180 and hanging flange 140 which now extends from both closed top wall 180 and one of the sidewalls.

In the preferred embodiment of the instant invention, display container 10 is formed from totally transparent or translucent polymer material such as a sheet of rigid polyvinyl chloride having a high impact resistance, and a preferred thickness of about 0.010 gauge or ten thousandths of an inch. Any rigid or semi-rigid plastic material, however, such as polyethylene, polystyrene, etc. may be used in place of the preferred plastic polyvinyl chloride. Thus, as shown in FIG. 3, front wall 14, rear wall 12, side wall 16 and 18, integral panel 20, upper side wall flanges 24 and 26, first regions 28 and 30, second regions 29 and 31, lower side wall flanges 48 and 58, lower front wall flange 50, and lower rear wall flange 60 are all made in one integral piece formed from a single blank.

Figure 11:
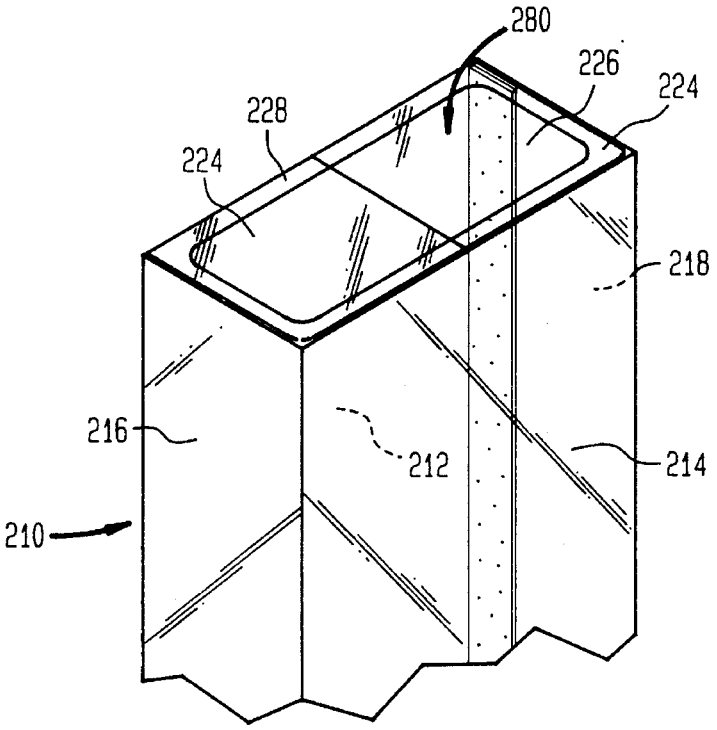
FIG. 11 is a perspective view of a top section of a container in a sealed condition in accordance with yet another embodiment of the present invention.

Referring now to FIG. 11, a display container in accordance with one aspect of the present invention is shown and generally designated as 210.

The construction of display container 210 is similar to the display container shown in FIG. 1 in that it includes rear wall 212, front wall 214, and side walls 216 and 218 as shown. Display container 210 also includes upper side wall flanges 224 and 226 which are connected to side walls 216 and 218 respectively by fold lines. Display container 210 further includes upper flanges 224 and 228 which are connected to rear wall 212 and front wall 214 respectively by fold lines. Unlike display container 10 shown in FIG. 1, however, flanges 224 and 228 are constructed such that they overlap one another when folded down to form closed top wall 280 as shown in FIG. 11. In this manner, flanges 228 and 224 can be permanently bonded to one another such that closed top wall 280 will be in a permanently sealed, tamper-proof condition.

Although it is preferable that flanges 224 and 228 fully overlap as shown in FIG. 11, flanges 224 and 228 may partially overlap one another and be bonded along only the overlapping section or need not overlap at all. In the case in which there is no overlapping, flanges 224 and 228 can be permanently bonded to upper side wall flanges 224 and 226 to provide permanently bonded top wall 280.

The manner in which closed top wall 280 is bonded is conventional and known to one of ordinary skill in the art. For example, a metallic plate or electrode may be inserted between upper side wall flanges 224, 226 and upper flanges 224, 228, i.e., above the side wall flanges but below the upper flanges 224 and 228. A corresponding metallic plate or electrode can then be placed above upper flanges 224 and 228 in order to deliver the appropriate ultrasonic or radio frequency waves (or vibration welding) for permanently bonding together upper flanges 224 and 228 to form closed top wall 280. In addition, if the display container is formed from stiff enough material (such as a very rigid PVC), a metallic plate or electrode would not be needed for insertion underneath the flanges that are to be bonded and a single electrode or bonding tool can be placed directly above the area(s) to be bonded.

Figure 10:
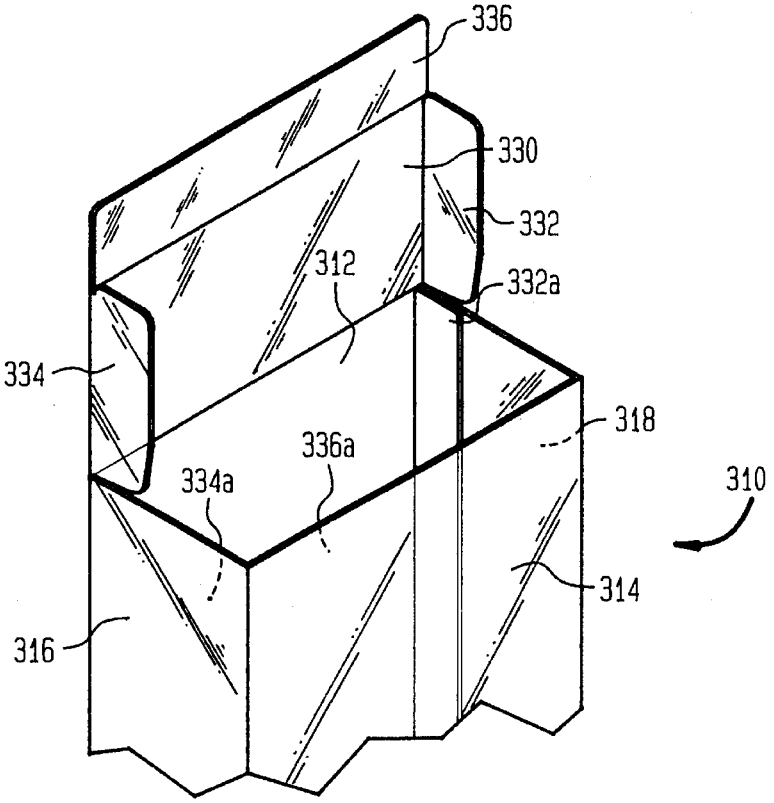
FIG. 10 is a perspective view of a top section of a container in accordance with another embodiment of the present invention prior to sealing.

Turning to FIG. 10, a top portion of display container 310 according to another embodiment of the present invention is illustrated. In this embodiment, a single, upper flange 330 is provided and depends from rear wall 312 by a fold line. Depending from flange 330 by fold lines is front tuck flap 336 and a pair of side tuck flaps 332 and 334. Tuck flaps 332, 334 and 336 are adapted to be permanently bonded to upper portions 332a, 334*a* and 336*a* of side walls 318, 316 and front wall 314 respectively after flange 330 is closed to provide a permanently bonded top wall. Although tuck flaps 332, 334 and 336 are preferably tucked within display container 310 and then bonded to their respective front and side walls, one or all of the tuck flaps may also be bonded to the outside of display container 310.

Although FIGS. 10 and 11 illustrate only the top portion of the display container, the bottom portion may be identical to the top portion in construction or may include an automatic bottom configuration as shown in FIG. 1 and as described above. The display container of FIGS. 10 and 11 may also include a hanging tab or J-hook flange as shown in either FIG. 5 or FIG. 9. The hanging tab may be integrally formed with the display container or may be separately provided and adhered thereto by conventional techniques such as gluing or by adhesive tape, or can be permanently bonded thereto. The hanging tab portion may be formed from a single layer of material or may be formed from a pair of corresponding portions that can be permanently bonded to one another as discussed above and as shown in FIGS. 5 and 9.

Moreover, the display containers of FIGS. 5 and 9 can also be provided with a permanently bonded top wall in addition to the permanently bonding of second regions 29 and 31 (FIG. 5) and 129 and 131 (FIG. 9). Thus, a number of different configurations of bottom and top walls both with and without hanging tab portions may be constructed in accordance with the present invention such that the display container provided has at least one permanently bonded end and is tamper resistant.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A method of packaging comprising the steps of:

(a) providing a display container comprising permanent side walls, a first end comprising at least two side wall flanges depending from said side walls, and a second end sealable to form a closed bottom wall and wherein said second end is attached along at least a portion thereof and is so constructed such that when said display container is moved to its set-up position, said second end forms said closed bottom wall;

(b) setting up said display container to its set up position to form a walled enclosure;

(c) filling said display container with a desired product;

(d) sealing said second end to form said closed bottom wall;

(e) permanently bonding at least a portion of one of said side wall flanges to at least another of said side wall flanges to form a closed, bonded top wall to maintain said display container in a permanently sealed condition so that said product inside said display container is inaccessible from either said top or bottom wall.

2. A method according to claim 1, wherein said second end is permanently pre-sealed along at least a portion thereof.

3. A method according to claim 1 or 2, wherein said display container is provided in a flat condition and said step of setting up is performed by standard packaging machinery.

4. A method according to claim 1 or 2, wherein said display container is provided in a flat condition and said step of setting up is performed by hand.

5. A method according to claim 1, wherein each of said side wall flanges comprises a seal region and said step of permanently bonding further includes bonding at least a portion of one of said seal regions to the other said seal region to form both said top wall and a bonded portion extending therefrom.

6. A method according to claim 5, wherein said each of said side wall flanges comprises a first region adjacent one of said side walls and a second region adjacent said first region and said step of permanently bonding includes the step of permanently bonding at least a portion of one of said second regions to the other of said second regions such that said second regions form said bonded portion and said first regions form said closed top wall.

7. A method according to claim 6, wherein said first region of each of said side wall flanges depends from said side wall by a fold line and said second region depends from said first region by a fold line and is coextensive therewith.

8. A method according to claim 5, wherein said bonded portion is formed with a J-hook recess therein to facilitate hanging said display container from a rack.

9. A method according to claim 8, wherein each of said seal regions is provided with a complimentary J-hook adapted to form said J-hook recess in said bonded portion.

10. A method according to claim 5, wherein one of said side wall flanges comprises a first region adjacent said side wall and a second region adjacent said first region, and said step of permanently bonding includes the step of permanently bonding at least a portion of said second region to said seal region of the opposing said side wall flange such that said second region and said seal region form said bonded portion and said first region forms said closed top wall.

11. A method according to claim 10, wherein said first region depends from said side wall by a fold line, said second region depends from said first region by a fold line and is coextensive therewith, and said seal region of said opposing side wall flange depends from said side wall by a fold line.

12. A method according to claim 5, further including the step of placing at least one insert member inside said display container for displaying desired information about said product.

13. A method according to claim 12, wherein said insert member is formed from opaque material and is coextensive with at least a portion of one of said side walls.

14. A method according to claims 1 or 2, wherein said step of permanently bonding comprises radio-frequency (RF) heat sealing.

15. A method according to claim 1 or 2, wherein said step of permanently bonding comprises ultrasonic frequency sealing.

16. A method according to claims 1 or 2, wherein said step of permanently bonding comprises vibration welding.

17. A method of packaging comprising the steps of:

(a) providing a display container comprising permanent side walls, a first end comprising at least one side wall flange depending from one of said side walls, and a second end sealable to form a closed bottom wall;

(b) setting up said display container to its set-up position to form a walled enclosure;

(c) filling said display container with the desired product;

(d) sealing said second end to form said closed bottom wall; and (e) permanently bonding at least a portion of said side wall flange to at least one of said side walls to form a closed, bonded top wall to maintain said display container in a permanently sealed condition so that said product inside said display container is inaccessible from either said bottom or top wall, and wherein said side wall flange comprises a front tuck flap and a pair of side tuck flaps extending therefrom, and said step of permanently bonding includes the step of permanently bonding at least a portion of said front and side tuck flaps to corresponding said side walls of said display container to form said closed, bonded top wall.

18. A method of packaging comprising the steps of:

(a) providing a display container comprising permanent side walls, a first end comprising at least one side wall flange depending from one of said side walls, and a second end sealable to form a closed bottom wall;

(b) setting up said display container to its set-up position to form a walled enclosure;

(c) filling said display container with the desired product (d) sealing said second end to form said closed bottom wall; and (e) permanently bonding at least a portion of said side wall flange to at least one of said side walls to form a closed, bonded top wall to maintain said display container in a permanently sealed condition so that said product inside said display container is inaccessible from either said bottom or top Wall, and wherein said second end comprises at least two side wall flanges depending from said side walls, and said step of sealing said second end comprises the step of permanently bonding at least a portion of one of said side wall flanges of said second end to another of said side wall flanges to form a closed, bonded bottom wall.

19. A method according to claim 17 or 18, wherein said step of permanently bonding comprises radio-frequency (RF) heat sealing.

20. A method according to claim 17 or 18, wherein said step of permanently bonding comprises ultrasonic frequency sealing.

21. A method according to claim 17 or 18, wherein said step of permanently bonding comprises vibration welding.

22. A method according to claim 17 or 18, wherein said display container is provided in a flat condition and said step of setting up is performed by standard packaging machinery.

23. A method according to claim 17 or 18, wherein said display container is provided in a flat condition and said step of setting up is performed by hand.

24. A method of packaging comprising the steps of:

(a) providing a display container comprising permanent side walls, a first end comprising at least one side wall flange depending from one of said side walls, and a second end sealable to form a closed bottom wall;

(b) setting up said display container to its set-up position to form a walled enclosure;

(c) filling said display container with the desired product;

(d) sealing said second end to form said closed bottom wall; and (e) permanently bonding at least a portion of said side wall flange to at least one of said side walls to form a closed, bonded top wall to maintain said display container in a permanently sealed condition so that said product inside said display container is inaccessible from either said bottom or top Wall, and wherein said second end is attached along at least a portion thereof and is so constructed such that when said display container is moved to its set up position, said second end forms said closed bottom wall.

25. A method according to claim 24, wherein said second end is permanently pre-sealed along at least a portion thereof.

* * * * *

UNITED STATES PATENT AND TRADEMARK OFFICE

CERTIFICATE OF CORRECTION

PATENT NO. : 5,499,484

DATED : March 19, 1996

INVENTOR(S) : Herrin

It is certified that error appears in the above-identified patent and that said Letters Patent is hereby corrected as shown below:

Column 8, line 32, "60'" should read --α'--.

Column 14, line 21 "Wall" should read --wall--.

Column 14, line 58, "Wall" should read --wall--.

Signed and Sealed this

Second Day of July, 1996

Bruce Lehman

*Attest:*

BRUCE LEHMAN

*Attesting Officer*

*Commissioner of Patents and Trademarks*